US005634807A

United States Patent [19]

Saito

[11] Patent Number: 5,634,807

[45] Date of Patent: Jun. 3, 1997

[54] WATERPROOF STRUCTURE OF CONNECTOR

[75] Inventor: Hitoshi Saito, Shizuoka-ken, Japan

[73] Assignee: Yazaki Corporation, Tokyo, Japan

[21] Appl. No.: 409,687

[22] Filed: Mar. 23, 1995

[30] Foreign Application Priority Data

Mar. 24, 1994 [JP] Japan ..... 6-054136

[51] Int. Cl.[6] ..... H01R 13/52

[52] U.S. Cl. ..... 439/275; 439/589

[58] Field of Search ..... 439/587, 589, 439/271, 274–5, 278, 280, 283

[56] References Cited

U.S. PATENT DOCUMENTS

| | | | |
|---|---|---|---|
| 4,973,268 | 11/1990 | Smith et al. | 439/589 |
| 5,252,088 | 10/1993 | Morello et al. | 439/271 |
| 5,299,949 | 4/1994 | Fortin | 439/589 |

FOREIGN PATENT DOCUMENTS

P 3-122979 5/1991 Japan .

*Primary Examiner*—David L. Pirlot
*Assistant Examiner*—Brian J. Biggi
*Attorney, Agent, or Firm*—Wigman, Cohen, Leitner & Myers, P.C.

[57] ABSTRACT

A waterproof structure of a connector comprises a rubber waterproof plug (17, 61, 67, 71) engaged with a rear end portion (24) of a connector (23) for waterproofing of the connector, the rubber waterproof plug being formed with a plurality of wire insertion holes (27) through which wires (31) led out of the connector are passed under airtight condition. The plug is also provided with at least one non-used wire insertion hole (35) and with a waterproof plug cover (19, 63) also engaged with the rear end portion (24) of the connector for covering the rubber waterproof plug, the waterproof plug cover being formed with a plurality of wire leading holes (45) through which the wires (31) passed through the wire insertion holes (27) are led out to the outside. The cover is also provided with at least one sealing portion (47) for sealing the non-used wire insertion hole or holes (35) and, in particular, with at least one waterproof rib (33, 65) formed integral with the rubber waterproof plug (17) at the non-used wire insertion hole (35) thereof, or formed integral with the waterproof plug cover (19, 63) at the sealing portion (47) thereof, so as to project from the rubber waterproof plug to the waterproof plug cover or, vice versa, into airtight contact with the an opposing surface thereof when the waterproof plug cover (19) is fitted to the rubber waterproof plug (17). Therefore, the non-used wire insertion hole (35) of the rubber waterproof plug (17) can be sealed easily and securely by the waterproof rib (33), and the shape of the rubber waterproof cover (19) can also be simplified.

13 Claims, 6 Drawing Sheets

WATERPROOF STRUCTURE OF CONNECTOR

BACKGROUND OF THE INVENTION

1. Technical Field

The present invention relates to a waterproof structure of a connector, and more specifically to a waterproof structure provided at a rear end portion of a connector for preventing water from entering the connector.

2. Description of the Related Art

An example of a prior art waterproof structure of a connector is disclosed in Japanese Published Unexamined (Kokai) Patent Application No. 3-122979, which is roughly composed of a rubber waterproof plug and a rubber plug cover, both for enclosing the rear end portion of a connector in cooperation with each other. In this example, the rubber waterproof plug is formed with a sealing projection extending along the outer side surface of a square-shaped rubber plate so as to be air-tightly fitted to a rear end portion of a connector for prevention of water from entering the connector. Further, the rubber waterproof plug is formed with a plurality of wire insertion holes through which wires extending from the connector are passed under airtight condition. On the other hand, the rubber plug cover is so formed as to be fitted to the rear end portion of the connector so as to hold the rubber waterproof plug between the connector and the plug cover. The rubber plug cover is also formed with a plurality of wire leading holes which communicate with the wire insertion holes of the rubber waterproof plug so that the wires can be led out from the inside of the connector to the outside thereof.

In the prior art rubber waterproof plug as described above, however, there inevitably exists such a case that the wires are not passed through all the wire insertion holes. In more detail, when the number of the wires led out of the connector is less than the number of the wire insertion holes of the rubber waterproof plug, some wire insertion holes are left open. To close these open wire insertion holes, some hollow cylindrical projections are formed at such positions as to correspond to the non-used wire leading holes formed in the rubber plug cover, and in such a way as to be inserted into each of the non-used wire insertion holes formed in the rubber waterproof plug under airtight condition so that the non-used wire insertion holes (through which no wires are passed) can be closed air-tightly. Further, when the positions of the non-used wire insertion holes change for each use, the hollow cylindrical projections are removed or punched out by use of a punch-out tool, so that the wires can be passed through both the wire insertion holes and the wire leading holes. In other words, in the prior art rubber waterproof plug, the rubber plug cover is formed with some projections inserted into the non-used wire insertion holes of the rubber waterproof plug, In such a way that the projections can be removed in correspondence to the number of wires to be led out of the connector.

In the prior art rubber waterproof structure, however, since the rubber plug cover is formed with some projections, there exists a problem in that the projections are easily damaged by an external force during transport, and thereby the sealing performance of the projections (i.e., the waterproof structure) of a connector deteriorates. In addition, since it is necessary to locate the projections at the non-used wire insertion holes before inserting the projections thereinto, there exists another problem in that the mounting of the rubber plug cover to the waterproof plug is troublesome, and therefore it takes a relatively long time.

Furthermore, there exists another problem in that, since thin wall thickness projections must be formed so as to rise from the outer circumferential edge portions of the openings of the wire leading holes of the rubber plug cover, the shape of the rubber molding die is complicated and therefore costly.

SUMMARY OF THE INVENTION

With these problems in mind, therefore, it is the object of the present invention to provide a waterproof structure for a connector which can easily and securely seal the non-used wire insertion holes formed in the rubber waterproof plug, while simplifying the shape of the waterproof cover.

To achieve the above-mentioned object, the present invention provides a waterproof structure of a connector, including: a rubber waterproof plug (17, 61, 67, 71) engaged with a rear end portion (24) of a connector (23) for waterproofing of the connector, said rubber waterproof plug being formed with a plurality of wire insertion holes (27) through which wires (31) led out of the connector are passed under airtight condition and with at least one non-used wire insertion hole (35); a waterproof plug cover (19, 63) also engaged with the rear end portion (24) of the connector for covering said rubber waterproof plug, said waterproof plug cover being formed with a plurality of wire leading holes (45) through which the wires (31) passed through the wire insertion holes (27) are led out to the outside and with at least one sealing portion (47) for sealing the at least one non-used wire insertion hole (35); and at least one waterproof rib (33, 65) formed integral with said rubber waterproof plug (17) at the non-used wire insertion hole (35) thereof or with said waterproof plug cover (19, 63) at the sealing portion (47) thereof, so as to project from said rubber waterproof plug to said waterproof plug cover or vice versa into airtight contact with the opposing surface thereof when said waterproof plug cover (19) is fitted to said rubber waterproof plug (17).

Further, said at least one waterproof rib (33) is formed at a circumferential edge portion of an outside opening of the non-used wire insertion hole (35) of said rubber waterproof plug (17), or said at least one waterproof rib (65) is formed In an inside surface of the sealing portion (47) of said waterproof plug cover (63).

Further, it is preferable that said at least one waterproof rib (33, 65) is formed into an annular shape. Further, it is preferable that a plurality of said annular waterproof ribs (33, 69) are formed coaxially at the circumferential edge portion of an outside opening of the non-used wire insertion hole (35) of said rubber waterproof plug (17) or a plurality of said annular waterproof ribs (65) are formed coaxially in an inside surface of the sealing portion (47) of said waterproof plug cover (63).

Further, it is also preferable that a plurality of said waterproof ribs (33) are formed at all the circumferential edge portions of the outside openings of the wire insertion holes (27) of said rubber waterproof plug (17), In addition to the non-used wire insertion holes (33) thereof.

In the waterproof structure of a connector according to the present invention, since at least one waterproof rib is formed at any one of the circumferential edge portions of the opening of the non-used wire insertion hole of the rubber waterproof plug or that of the sealing portion of the waterproof plug cover, whenever the waterproof plug and the plug cover are engaged with the rear portion of the connector, it is possible to securely seal a gap between the non-used wire insertion hole of the waterproof plug and the sealing portion of the plug cover. Further, since no thin-wall hollow projections are formed in the waterproof plug cover (being different from the prior art), it is possible to simplify the shape of the waterproof plug cover, so that the molding die thereof can be simplified.

Further, when the annular rib is formed on the plug cover side or when the annular ribs are formed at all of the respective openings of the wire insertion holes of the waterproof plug it is possible to use the waterproof plug in common in correspondence to various numbers of wires to be led from the connector, as far as several plug covers are prepared.

Further, in the waterproof structure according to the present invention, since an annular rib is used for waterproofing of the non-used wire insertion hole, it is possible to seal the non-used wire insertion holes uniformly, ever after the wires have been passed through the wire insertion holes.

Further, when a plurality of coaxial annular ribs are formed, it is possible to further improve the sealing performance of the waterproof structure of a connector.

DETAILED DESCRIPTION OF THE EMBODIMENTS

Embodiments of the waterproof structure of a connector will be described hereinbelow with reference to the attached drawings.

Figure 1A:
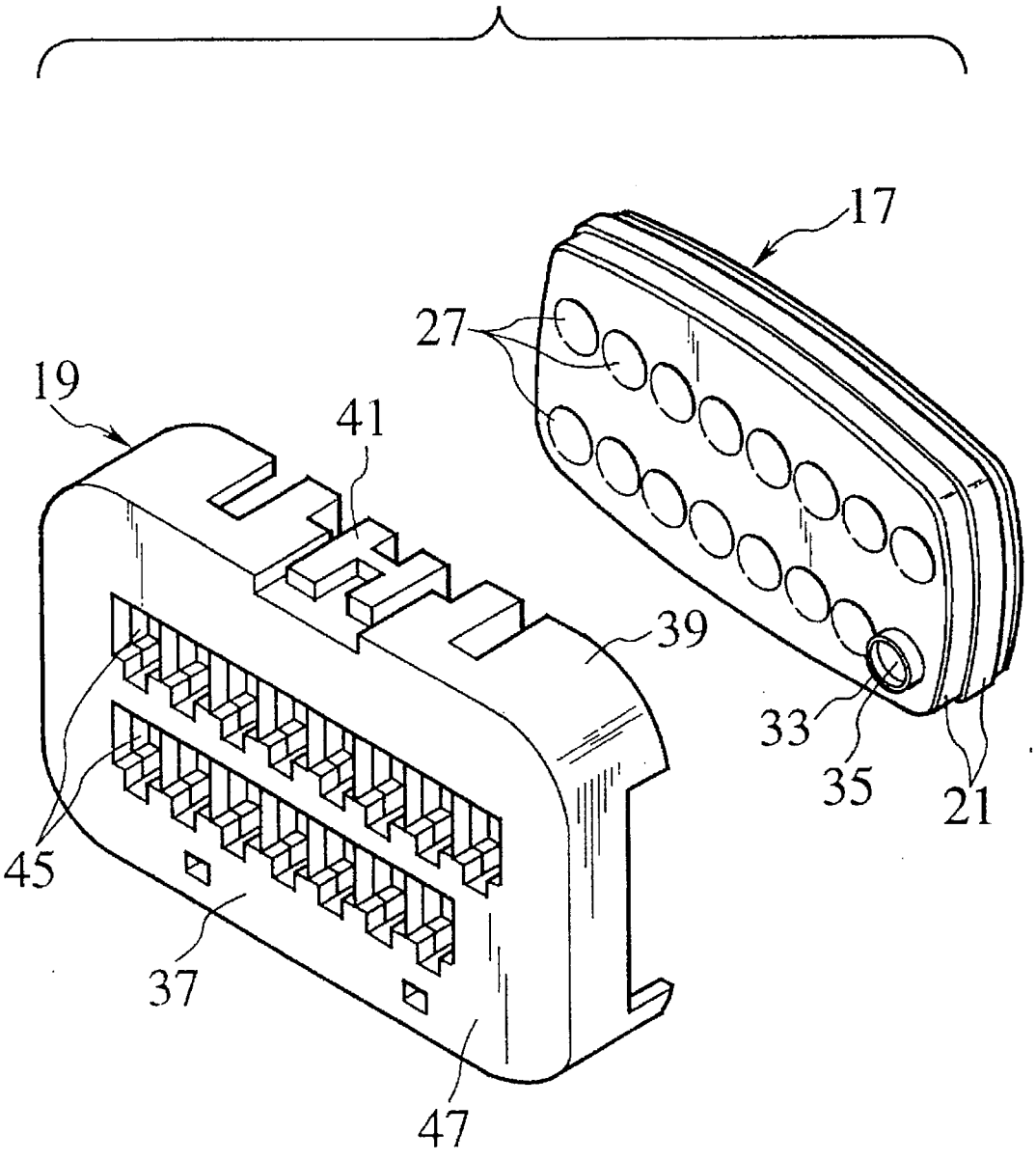
FIG. 1A is a perspective view showing a first embodiment of the rubber waterproof plug and the waterproof plug cover of the waterproof structure of a connector according to the present invention.
Figure 1B:
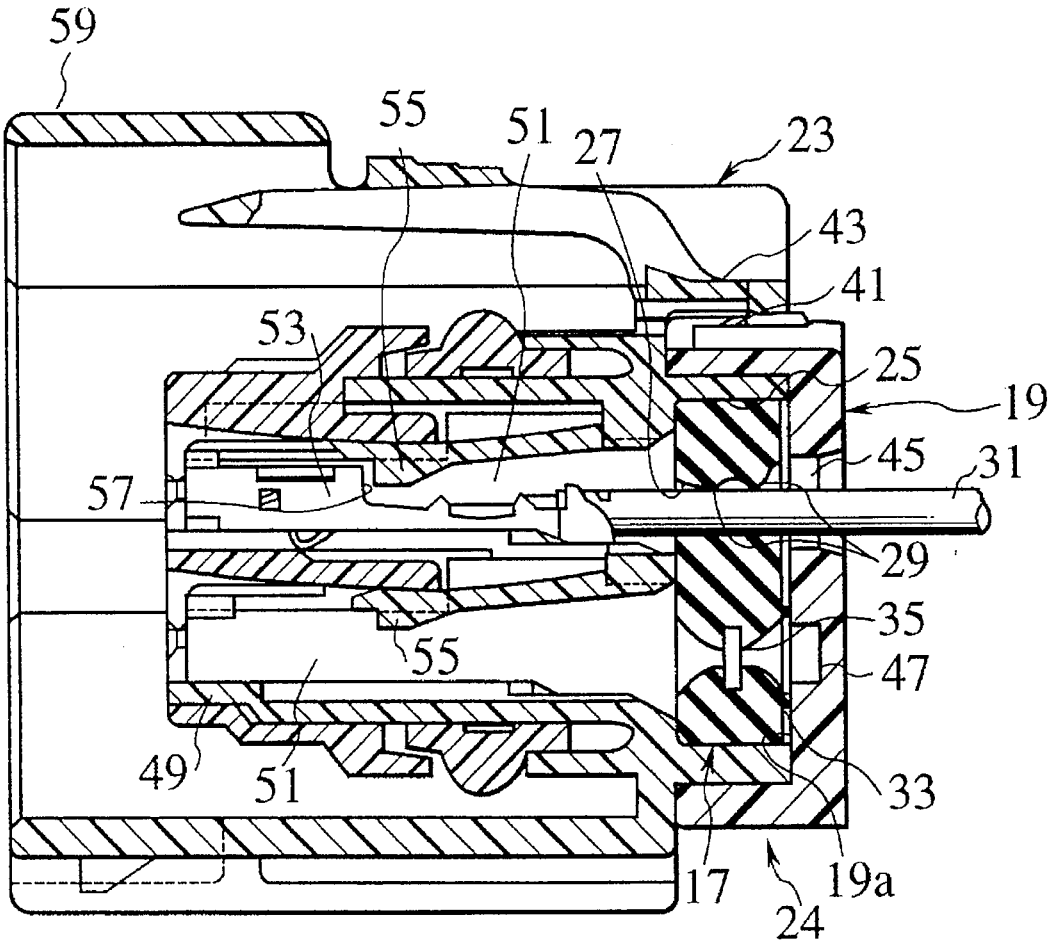
FIG. 1B is a cross-sectional view showing the rubber waterproof plug and the waterproof plug cover according to the present invention shown In FIG. 1A, which are both fitted to the rear end portion of a connector.
Figure 2:
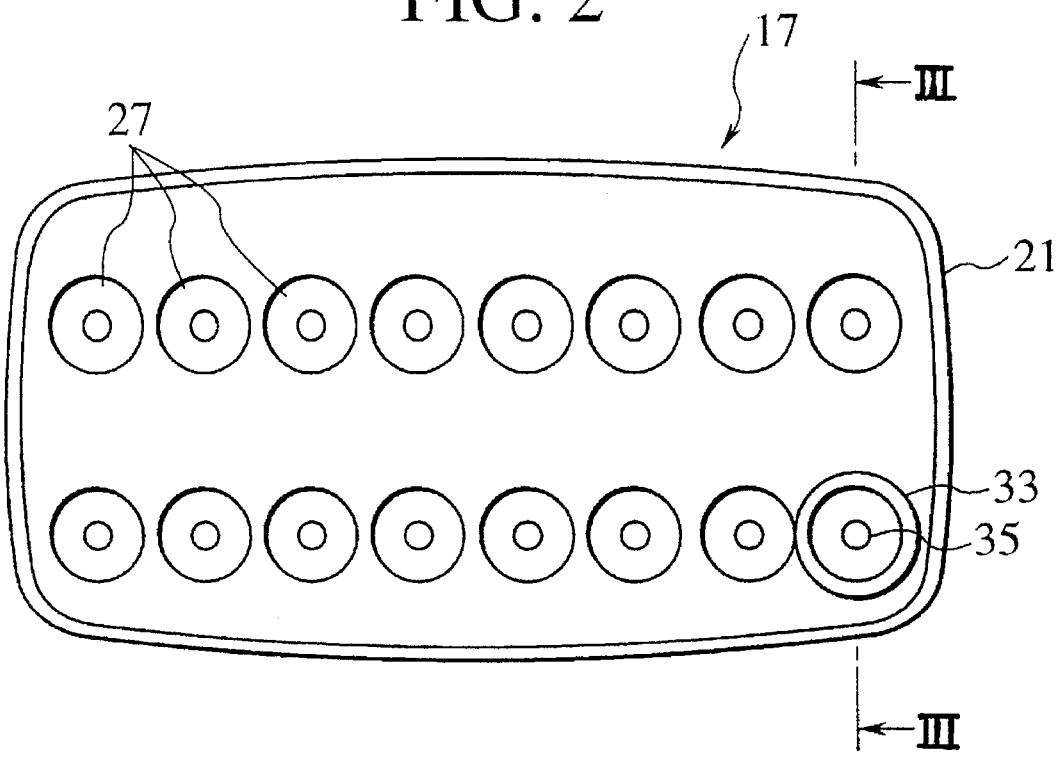
FIG. 2 a plan view showing the rubber waterproof plug shown in FIG. 1A.

As shown in FIG. 1A, the waterproof structure of a connector according to the present invention is roughly composed of a rubber waterproof plug 17 and a waterproof plug cover 19. The rubber waterproof plug 17 is formed of a soft rubber and into a square shape. The rubber waterproof plug 17 has some outer sealing projections 21 extending along the outer circumferential side surface thereof. As shown in FIG. 1B, the outer sealing projections 21 are air-tightly fitted to an inner wall of a rear engagement portion 25 of a rear end portion 24 of a male connector 23. Further, the rubber waterproof plug 17 is formed with a plurality of wire insertion holes 27 passing through the right and reverse surfaces thereof. As shown in FIG. 1B, two inner sealing projections 29 are formed in an inner wall surface of each of these wire insertion holes 27 in such a way that the diameter of each inner sealing projection 29 is slightly smaller than that of a wire 31 to be passed therethrough. Therefore, when the wire 31 is passed through the wire insertion hole 27, the inner sealing projections 29 are brought into tight contact with the outer circumference of the wire 31 for providing a more secure waterproof condition.

Figure 3:
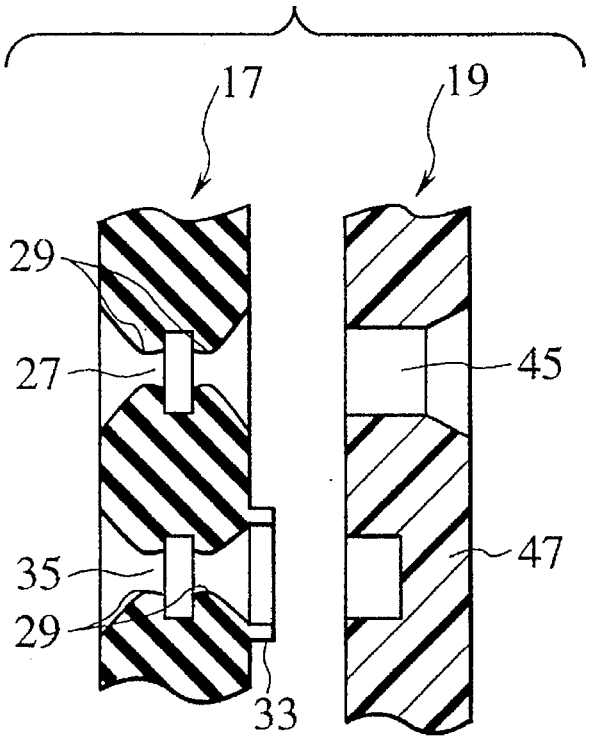
FIG. 3 is a cross-sectional view taken along the line III—III A shown in FIG. 2.
Figure 5:
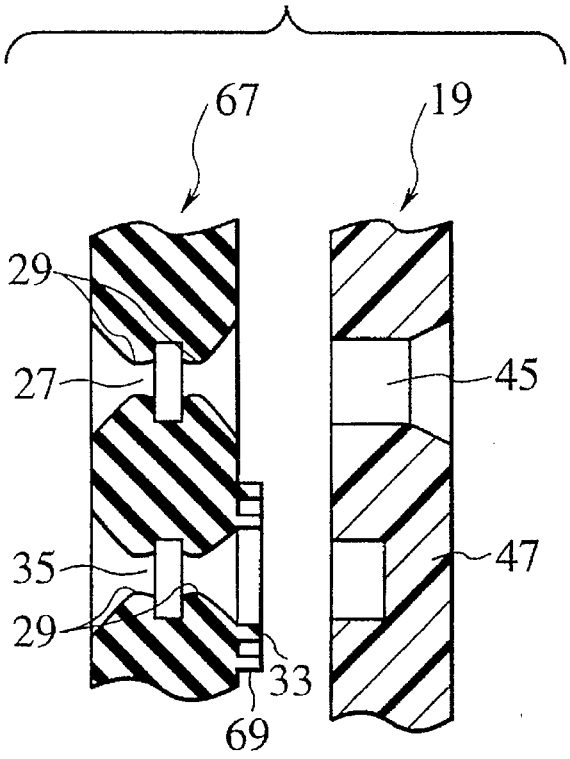
FIG. 5 is a partial cross-sectional view showing a third embodiment of the rubber waterproof plug and the waterproof plug cover of the present invention.

Further, in the case of the rubber waterproof plug 17 shown in FIGS. 1A and 1B and FIGS. 2 and 3, one wire insertion hole 35 is not used (through which no wire 31 is passed). In the case of the non-used wire insertion hole 35 of this first embodiment, an annular waterproof rib 33 is formed around and integral with the circumferential edge portion of an opening of the non-used wire insertion hole 35. The projection height of the waterproof rib 33 is determined to be such a dimension as to be brought into tight contact with the inner wall 19*a* of the waterproof plug cover 19 for providing a secure waterproof condition when the rubber waterproof plug 17 is fitted to the inner wall of the rear engage portion 25 of the connector, and when the waterproof plug cover 19 is engaged with the outer wall of the rear engage portion 25 of the connector, as shown in FIG. 1B. A sectional shape of the distal end of the annular waterproof rib 33 is rectangular as shown in FIGS. 3 and 5. But, without being limited only thereto, it is possible to make the sectional shape of the distal end of the rib 33 round. Here, in this embodiment, since the waterproof rib 33 is formed around the non-used wire insertion hole 35, it is possible to provide a secure airtight condition, that is, a waterproof condition around the non-used wire insert ion hole 35 and between the waterproof plug 17 and the plug cover 19, without inserting any projections into the non-used wire insertion hole 35.

On the other hand, the waterproof plug cover 19 is formed of the same substance as that of the male connecter 23. The waterproof plug cover 19 is composed of a plate-shaped closure portion 37 and a side wall 39 extending along the outer circumferential surface of the closure portion 37. A lock portion 41 is formed at a part of the side wall 39 so as to be engagement with an engage portion 43 formed in the outer wall of the rear engagement portion 25 of the connector 23, as shown in FIG. 1B. Further, a plurality of wire leading holes 45 are formed in the closure portion 37 at such positions as to communicate with the wire insertion holes 27 when the waterproof plug cover 19 is engagement with the rear engage portion 25 of the connector 23, as shown in FIG. 1B. Further, the waterproof plug cover 19 Is formed with a sealing portion 47 at a position which faces the non-used wire insertion hole 35.

The connector 23, to which the rubber waterproof plug 17 and the waterproof plug cover 19 are both fitted, will be explained hereinbelow with reference to FIG. 1B. The connector 23 is a male connector having a connector housing 49. The connector housing 49 is formed with terminal accommodation chambers 51, in each of which a female terminal 53 is accommodated when a flexible engagement arm 55 of the connector housing 49 is engaged with an engagement shoulder portion 57 of the terminal 53. The connector housing 49 is formed with the rear end engagement portion 25 at the rear end portion 24 at the rear end thereof, to an inner side of which the rubber waterproof plug 17 is air-tightly fitted, as already explained. Further, the waterproof plug cover 19 is engaged with the outer side of the same rear engagement portion 25 of the connector 23. In addition, an engagement hood portion 59 is formed on the outside of the connector housing 49 in such a way that an engagement hood portion (not shown) of a mated female connector (not shown) can be engaged with the hollow portion formed between the connector housing 49 and the engagement hood portion 59.

The fitting procedure of the rubber water plug 17 and the waterproof plug cover 19 to the connector 23 will be explained hereinbelow. Previously, the wires 31 connected to the female terminals 53 are passed through the wire insertion holes 27 of the rubber waterproof plug 17 and the wire leading holes 45 of the waterproof plug cover 19. Then, the female terminals 53 are housed in the terminal accommodating chambers 51, respectively. After that, the rubber waterproof plug 17 is moved toward the connector 23 so as to be engaged with the inner side of the rear engage portion 25 of the connector 23. Under these conditions, the wires 31 passed through the wire insertion holes 27 of the rubber waterproof plug 17 can be airtightly brought into contact with the wire Insertion holes 27, respectively. Further, the waterproof plug cover 19 is moved toward the connector 23 so as to be engaged with the outer side of the rear engagement portion 25 of the connector 23. Under these conditions, the annular waterproof rib 33 formed on the waterproof plug cover (19) side of the non-used wire insertion hole 35 of the rubber waterproof plug 17 is brought into airtight contact with the sealing portion 47 of the waterproof plug cover 19 to seal the non-used wire insertion hole 35 (through which no wire is passed).

In the rubber waterproof structure as described above, whenever the waterproof plug cover 19 is engaged with the rear engagement portion 25 of the connector 23, since the annular waterproof rib 33 of the rubber waterproof plug 17 can be brought into tight contact with the sealing portion 47 of the waterproof plug cover 19, it is possible to securely seal the non-used wire insertion hole 35 formed in the rubber waterproof plug 17. Further, it is unnecessary to align the wire leading holes 45 of the waterproof plug cover 19 with the wire insertion holes 27 of the rubber waterproof plug 17. Further, since no projections are formed in the waterproof plug cover 19 for closing the non-used wire insertion holes 35, the shape of the waterproof plug cover 19 can be simplified, and thereby the rubber molding die for molding the waterproof plug cover 19 can be simplified in shape, thus reducing the manufacturing cost thereof.

Figure 4:
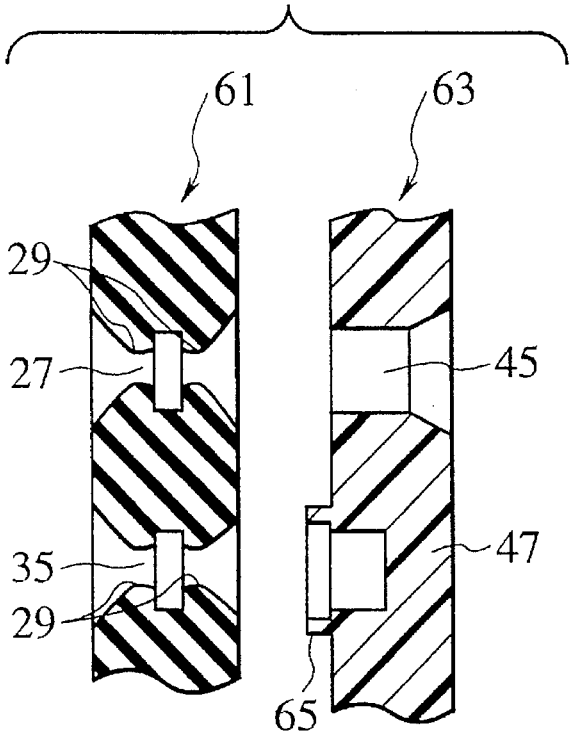
FIG. 4 is a partial cross-sectional view showing a second embodiment of the rubber waterproof plug and the waterproof plug cover of the present invention.

The other embodiments of the waterproof structure of a connector according to the present invention will be described. In the first embodiment, the annular rib 33 is formed at a circumferential edge portion of an outside opening of the non-used wire insertion hole 35 of the rubber waterproof plug 17 as shown in FIG. 3. In contrast with this, in the second embodiment as shown in FIG. 4, an annular waterproof rib 33 Is formed at a circumferential edge portion of an inside opening of the sealing portion 47 of a waterproof plug cover 63, that is, at such a position as to correspond to the non-used wire insertion hole 35 of the rubber waterproof plug 61.

Figure 6:
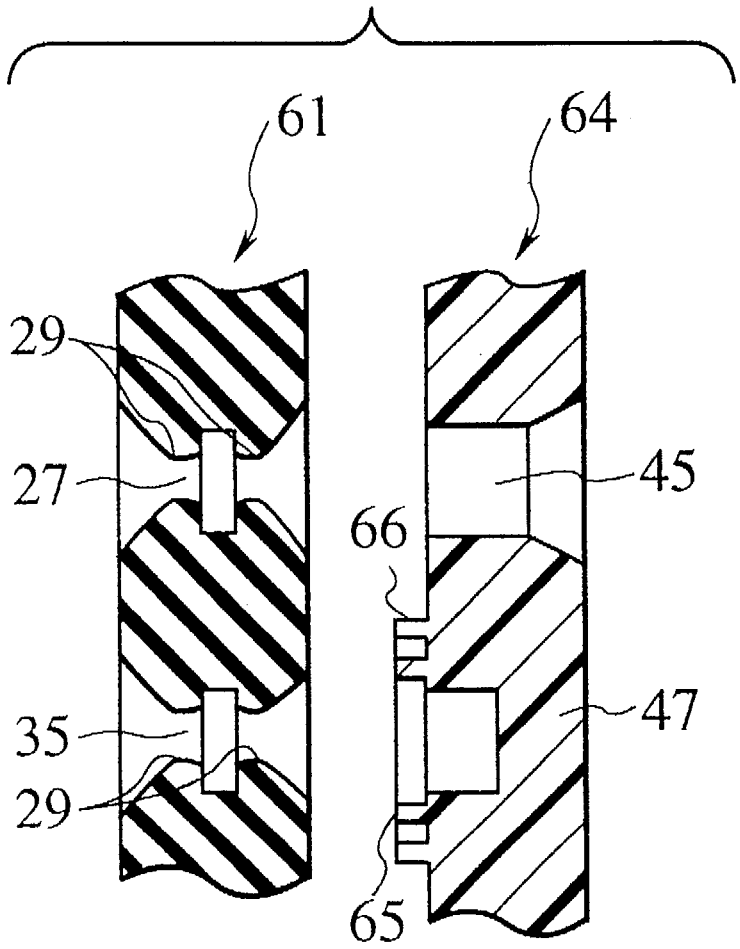
FIG. 6 is a partial cross-sectional view showing a fourth embodiment of the rubber waterproof plug and the waterproof plug cover of the present invention.

In this second embodiment, when the rubber waterproof plug 61 is engagement with the rear engage portion 25 of the connector 23, and when the waterproof plug cover 63 is engagement with the rear engage portion 25 of the connector 23, the annular waterproof rib 65 is brought into tight contact with the circumferential edge of the opening of the non-used wire insertion hole 35 of the rubber waterproof plug 61 to seal the non-used wire insertion hole 35. A sectional shape of the distal end of the annular waterproof rib 65 is rectangular as shown in FIGS. 4, and 6. But, without being limited only thereto, it is possible to make the sectional shape of the distal end of the rib 65 round.

In this second embodiment, the same effect as with the case of the first embodiment can be obtained. Further, as the waterproof plug covers 63 of several sorts having different sealing portions 47 are prepared, it is possible to use the rubber waterproof plug 61 in common in correspondence to the various numbers of wires to be passed through the wire insertion holes 27 of the rubber waterproof plug 61.

FIG. 5 shows a third embodiment according to the present invention. In this embodiment, the annular rib 33 is formed at the circumferential edge of the opening of the non-used wire insertion hole 35 of a rubber waterproof plug 67 in the same way as with the case of the first embodiment, and another annular rib 69 is additionally formed on the outer side of and coaxially with the annular rib 33.

According to the third embodiment, whenever the rubber waterproof plug 67 is engagement with the rear engage portion 25 of the connector 23, and when the waterproof plug cover 19 is also engagement with the rear engage portion 25 of the connector 23, since the two annular waterproof ribs 33 and 69 of the rubber waterproof plug 67 can be brought into tight contact with the sealing portion 47 of the waterproof plug cover 19, it is possible to further improve the sealing effect for the non-used wire insertion hole 35 formed in the rubber waterproof plug 67; that is, still a higher waterproof effect can be obtained.

FIG. 6 shows a fourth embodiment according to the present invention. In this embodiment, the annular rib 65 is formed at the circumferential portion of the inside surface of the sealing portion 47 of the waterproof plug cover 64 in the same way as with the case of the second embodiment, and another annular rib 66 is additionally formed on the outer side of and coaxially with the annular rib 65.

According to the fourth embodiment, in the same way as the third embodiment as shown in FIG. 5, it is possible to further improve the sealing effect for the non-used wire insertion hole 35 formed in the rubber waterproof plug 61; that is, still a higher waterproof effect can be obtained.

Figure 7:
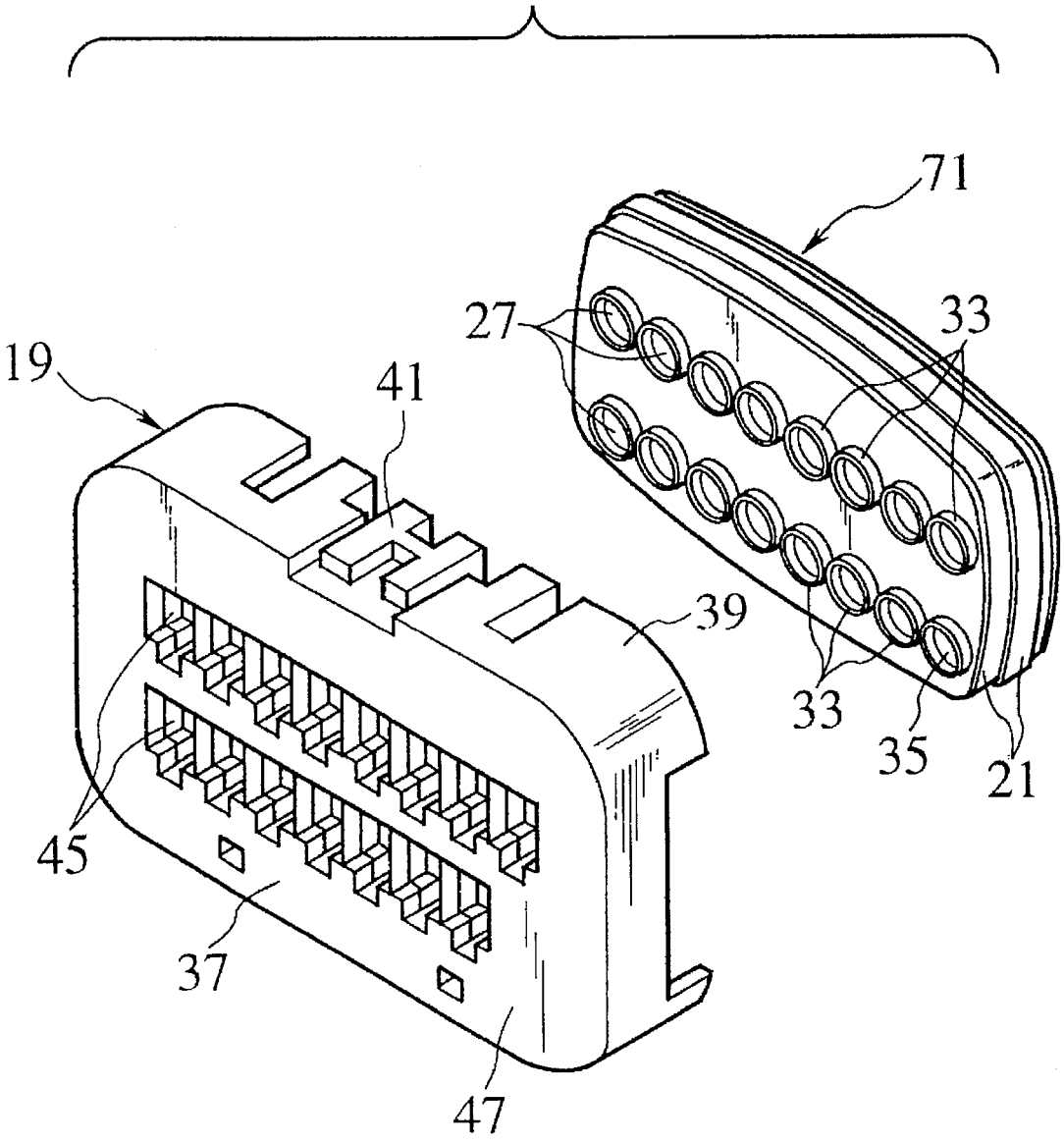
FIG. 7 is a cross-sectional view showing a fifth embodiment of the rubber waterproof plug and the waterproof plug cover of the present Invention.

FIG. 7 shows a fifth embodiment according to the present invention, in which the annular waterproof rib 33 is formed at all the circumferential edge portions of the openings of the wire Insertion holes 27, irrespective of the used or non-used wire insertion holes 27 or 35 formed in the rubber waterproof plug 71.

In this fifth embodiment, in the same way as with the case of the second embodiment as shown in FIG. 4, as the waterproof plug covers 19 of several sorts having different sealing portions 47 are prepared, it is possible to use the rubber waterproof plug 71 in common in correspondence to the various numbers of wires to be passed through the wire insertion holes 27 of the rubber waterproof plug 71, thus improving the usability of the rubber waterproof plug 71.

Further, in the above-mentioned embodiments, although only annular waterproof ribs 33, 65 and 69 have been described by way of example, without being limited thereto, however, it is possible to form these waterproof ribs 33, 65 and 69 into another shape (e.g., triangular, square, etc.) according to the shapes of the wire insertion holes 27 or 35.

As described above, in the waterproof structure according to the present invention, since at least one waterproof rib is formed at any one of the circumferential edge portions of the opening of the non-used wire insertion hole of the rubber waterproof plug or that of the sealing portion of the waterproof plug cover, whenever the waterproof plug and the plug cover are engaged with the rear portion of the connector, it is possible to securely seal a gap between the non-used wire insertion hole of the waterproof plug and the sealing portion of the plug cover. Further, since no thin-wall hollow projections are formed in the waterproof plug cover (being different from the prior art), it is possible to simplify the shape of the waterproof plug cover, so that the molding die thereof can be simplified.

Further, when the annular rib is formed on the plug cover side or when the annular ribs are formed at all the openings of the wire insertion holes of the waterproof plug respectively, it is possible to use the waterproof plug in common in correspondence to various numbers of wires to be led from the connector, as several plug covers are prepared.

Further, in the waterproof structure according to the present invention, since an annular rib is used for waterproofing of the non-used wire insertion hole, it is possible to seal the non-used wire insertion holes uniformly, even after the wires have been passed through the wire insertion holes.

Further, when a plurality of coaxial annular ribs are formed, it is possible to further improve the sealing performance of the waterproof structure of a connector.

What is claimed is:

1. A waterproof structure of a connector, comprising:

a waterproof plug engaged with a rear end portion of a connector for waterproofing the connector, said waterproof plug having formed therein a plurality of wire insertion through holes through which wires emerging from the connector are passed under airtight condition, said plurality of wire insertion through holes including at least one non-used wire insertion through hole;

a waterproof plug cover also engaged with the rear end portion of the connector for covering said waterproof plug, said waterproof plug cover having formed therein a plurality of wire leading holes for receiving the wires passing through the wire insertion through holes and for guiding said wires to the outside, said waterproof plug cover including at least one sealing portion for sealing said at least one non-used wire insertion through hole; and at least one waterproof rib formed integrally with said waterproof plug so as to project from a circumferential edge portion of an outside opening of said at least one non-used wire insertion through hole of said waterproof plug and onto an opposing surface of said waterproof plug cover so as to establish an airtight contact therewith when said waterproof plug cover is fitted to said waterproof plug.

2. The waterproof structure of a connector of claim 1, wherein said at least one waterproof rib is formed into an annular shape.

3. The waterproof structure of a connector of claim 3, wherein said at least one waterproof rib comprises a plurality of annular waterproof ribs formed coaxially at a circumferential edge portion of an outside opening of said at least one non-used wire insertion hole of said waterproof plug.

4. The waterproof structure of a connector of claim 2, wherein said at least one waterproof rib comprises a plurality of waterproof ribs formed at circumferential edge portions of outside openings of said wire insertion through holes of said waterproof plug, including said at least one non-used wire insertion through hole thereof.

5. The waterproof structure of a connector of claim 1, wherein said waterproof plug comprises a rubber waterproof plug.

6. The waterproof structure of claim 1, wherein said at least one sealing portion comprises at least one solid surface portion of said waterproof plug cover.

7. The waterproof structure of claim 6, wherein said at least one waterproof rib establishes an airtight contact with said at least one solid surface portion of said waterproof plug cover when said waterproof plug cover is fitted to said waterproof plug.

8. A waterproof structure of a connector, comprising:

a waterproof plug engaged with a rear end portion of a connector for waterproofing the connector, said waterproof plug having formed therein a plurality of wire insertion through holes through which wires emerging from the connector are passed under airtight condition, said plurality of wire insertion through holes including at least one non-used wire insertion through hole;

a waterproof plug cover also engaged with the rear end portion of the connector for covering said waterproof plug, said waterproof plug cover having formed therein a plurality of wire leading holes for receiving the wires passing through the wire insertion through holes and for guiding said wires to the outside, said waterproof plug cover including at least one sealing portion for sealing said at least one non-used wire insertion through hole, said at least one sealing portion comprising at least one solid surface portion of said waterproof plug cover; and at least one waterproof rib formed integrally with said at least one sealing portion of said waterproof plug cover so as to project from a circumferential edge portion of an outside opening of said at least one sealing portion of said waterproof plug cover and onto an opposing surface of said waterproof plug so as to establish an airtight contact therewith when said waterproof plug cover is fitted to said waterproof plug.

9. The waterproof structure of a connector of claim 6, wherein said at least one waterproof rib is formed into an annular shape.

10. The waterproof structure of a connector of claim 8, wherein said at least one waterproof rib comprises a plurality of annular waterproof ribs formed coaxially at a circumferential portion of an inside surface of said at least one sealing portion of said waterproof plug cover.

11. The waterproof structure of a connector of claim 6, wherein said waterproof plug comprises a rubber waterproof plug.

12. The waterproof structure of claim 6, wherein said at least one solid surface portion of said waterproof cover is discontinuous so as to form an inside opening of said at least one sealing portion at a position on said waterproof cover corresponding to a position of a given one of said at least one non-used wire insertion hole in said waterproof plug.

13. The waterproof structure of claim 14, wherein said at least one waterproof rib is formed at a circumferential edge portion of said inside opening of said at least one sealing portion.

* * * * *